US010912364B2

(12) United States Patent
Sayers et al.

(10) Patent No.: US 10,912,364 B2
(45) Date of Patent: Feb. 9, 2021

(54) HAIR DRYER

(75) Inventors: Stephen Anthony Sayers, Buckinghamshire (GB); Robert Alexander Weatherly, Cambridgeshire (GB); Daniel Brady, Berkshire (GB)

(73) Assignee: Jemella Limited, Leeds (GB)

( * ) Notice: Subject to any disclaimer, the term of this patent is extended or adjusted under 35 U.S.C. 154(b) by 95 days.

(21) Appl. No.: 14/239,569

(22) PCT Filed: Jul. 27, 2012

(86) PCT No.: PCT/GB2012/051813
§ 371 (c)(1),
(2), (4) Date: Apr. 30, 2014

(87) PCT Pub. No.: WO2013/027012
PCT Pub. Date: Feb. 28, 2013

(65) Prior Publication Data

US 2014/0345156 A1 Nov. 27, 2014

(30) Foreign Application Priority Data

Aug. 19, 2011 (GB) ..... 1114288.2

(51) Int. Cl.
*A45D 20/12* (2006.01)
*F25B 21/00* (2006.01)
(Continued)

(52) U.S. Cl.
CPC ..... *A45D 20/122* (2013.01); *A45D 20/08* (2013.01); *F26B 21/003* (2013.01)

(58) Field of Classification Search
CPC ..... A45D 20/00; A45D 20/04; A45D 20/08; A45D 20/10; A45D 20/12; A45D 20/42;
(Continued)

(56) References Cited

U.S. PATENT DOCUMENTS 3,359,192 A 12/1967 Heinrich
3,602,289 A * 8/1971 Barrett ..... B22C 7/065 164/234
(Continued)

FOREIGN PATENT DOCUMENTS

CN 1477937 A 2/2004
CN 1954737 A 5/2007
(Continued)

OTHER PUBLICATIONS

International Search Report for corresponding application PCT/GB2012/051813 filed Jul. 27, 2012; dated Jan. 2, 2013.
(Continued)

*Primary Examiner* — Tavia Sullens
(74) *Attorney, Agent, or Firm* — Schwegman Lundberg & Woessner, P.A.

(57) ABSTRACT

A hair dryer (10) has a hand-held housing comprising an air inlet (12), an air outlet (14), a motor (1) between said air inlet (12) and said air outlet (14) to draw air in from said air inlet (12) and drive air out from said air outlet (14). A heating element (17) is located in said air flow between said air inlet (12) and said air outlet (14). The hair dryer (10) further comprises a filter on said air inlet (12). The filter comprises a metal filter plate (20) bearing a plurality of holes, wherein at least some of said holes have a maximum lateral dimension of less than 1.5 mm and wherein vertical walls of said holes through a thickness of said filter plate are substantially straight or at least partially concave.

11 Claims, 4 Drawing Sheets

(51) Int. Cl.
*A45D 20/08* (2006.01)
*F26B 21/00* (2006.01)

(58) Field of Classification Search
CPC ..... A45D 20/26; A45D 20/34; A45D 20/122; F26B 21/003
USPC ..... 34/96, 97, 283
See application file for complete search history.

(56) References Cited

U.S. PATENT DOCUMENTS

| | | | | | |
|---|---|---|---|---|---|
| 3,691,646 | A | | 9/1972 | Ruffolo | |
| 4,197,448 | A | | 4/1980 | Harigai | |
| D258,092 | S | * | 1/1981 | Forsberg | D28/18 |
| 4,382,174 | A | * | 5/1983 | Barns | A45D 20/10 34/96 |
| 4,794,225 | A | | 12/1988 | Maese | |
| 5,118,252 | A | * | 6/1992 | Chaney | F04D 29/703 415/119 |
| 5,216,822 | A | | 6/1993 | Madiedo | |
| 5,243,682 | A | | 9/1993 | Eberts | |
| 5,243,683 | A | | 9/1993 | Yang | |
| 5,275,339 | A | * | 1/1994 | Andis | A45D 20/122 D28/18 |
| 5,448,677 | A | | 9/1995 | Fell | |
| 5,490,336 | A | | 2/1996 | Smick | |
| 5,810,911 | A | | 9/1998 | Behrendt et al. | |
| 6,199,295 | B1 | | 3/2001 | Smal | |
| D546,413 | S | * | 7/2007 | Sedwick | D23/213 |
| D678,724 | S | * | 3/2013 | Sayers | D7/376 |
| D678,725 | S | * | 3/2013 | Sayers | D7/376 |
| 8,893,400 | B2 | | 11/2014 | Carme | |
| 9,237,789 | B2 | | 1/2016 | Prehodka | |
| 2001/0055540 | A1 | * | 12/2001 | Bonamarte | A61L 9/02 422/4 |
| 2011/0197466 | A1 | | 8/2011 | Shami | |

FOREIGN PATENT DOCUMENTS

| | | | | | |
|---|---|---|---|---|---|
| CN | 202218686 | U | | 5/2012 | |
| DE | 3115569 | A1 | | 12/1982 | |
| DE | 3903442 | A1 | * | 8/1990 | H01H 15/22 |
| EM | 000570668 | | | 8/2006 | |
| EM | 005706680001 | | | 8/2006 | |
| EP | 0476664 | B1 | | 7/1995 | |
| EP | 2002752 | | | 12/2008 | |
| EP | 2002752 | A2 | | 12/2008 | |
| EP | 2401939 | A1 | * | 1/2012 | A45D 20/12 |
| FR | 987415-0003 | | | 12/1998 | |
| FR | 9871450003 | | | 12/1998 | |
| GB | 1202416 | | | 8/1970 | |
| GB | 2016051 | A | | 9/1979 | |
| GB | 2163574 | A | | 2/1986 | |
| GB | 2318544 | A | | 4/1998 | |
| JP | 2004293389 | | | 10/2004 | |
| JP | 2012019865 | A | | 2/2012 | |
| KR | 20030060089 | A | | 7/2003 | |
| KR | 1020090119155 | A | | 11/2009 | |
| WO | 2008097994 | A2 | | 8/2008 | |
| WO | WO-2013027012 | A1 | | 2/2013 | |

OTHER PUBLICATIONS

Written Opinion for corresponding application PCT/GB2012/051813 filed Jul. 27, 2012; dated Jan. 2, 2013.
British Examination Report under section 18(3) for corresponding application No. GB1114288.2 dated Apr. 20, 2012.
British Search Report for corresponding application No. GB1114288.2; dated Dec. 4, 2012.
First Examination Report, New Zealand, IP No. 620286 dated Jul. 28, 2014.
Request for Opinion regarding Patent No. GB2487996; dated Mar. 5, 2015.
Observation for corresponding application GB2487996 dated Apr. 7, 2015.
Observations submitted by Patentee for corresponding patent No. GB2487996 (Jemella Limited).
Opinion under Section 74(A); dated Jun. 4, 2015.
Statement-Opinion Request Letter for corresponding patent GB2487996.
W.T. Harris, "The Technology of Cutting Materials by Etching", published 1976 Clarendon Press, ISBN 019 8591152, pp. 182-195.
W.T. Harris, "The Technology of Cutting Materials by Etching", published 1976 Clarendon Press, ISBN 019 8591152, pp. 46-68.
"Australian Application Serial No. 2012298347, First Examiners Report dated Aug. 24, 2015", 3 pgs.
"Australian Application Serial No. 2012298347, Response filed Nov. 12, 2015 to First Examiners Report dated Aug. 24, 2015", 18 pgs.
"European Application Serial 12751573.2, Communication Pursuant to Article 94(3) EPC dated Mar. 7, 2017", 5 pgs.
"European Application Serial No. 12751573.2, Communication Pursuant to Article 94(3) EPC dated Mar. 7, 2017", 5 pgs.
"European Application Serial No. 12751573.2, Response filed Jul. 5, 2017 to Communication Pursuant to Article 94(3) EPC dated Mar. 7, 2017", 9 pgs.
"European Application Serial No. 12751573.2, Response filed Sep. 17, 2014 to Communication pursuant to Rules 161(1) and 162 EPC dated Mar. 26, 2014", 11 pgs.
"International Application Serial No. PCT/GB2012/051813, International Preliminary Report on Patentability dated Mar. 6, 2014", 11 pgs.
"United Kingdom Application Serial No. 1114288.2, Office Action dated Feb. 13, 2012", 5 pgs.
"United Kingdom Application Serial No. 1114288.2, Office Action dated Apr. 26, 2013", 2 pgs.
"United Kingdom Application Serial No. 1114288.2, Response filed Mar. 25, 2013 to Office Action dated Dec. 4, 2012", 16 pgs.
"United Kingdom Application Serial No. 1114288.2, Response filed May 8, 2013 to Office Action dated Apr. 26, 2013", 27 pgs.
"United Kingdom Application Serial No. 1114288.2, Response filed May 23, 2012 to Office Action dated Apr. 20, 2012", 21 pgs.
"United Kingdom Application Serial No. 1720073.4, Combined Search and Examination Report dated Jan 30, 2018", 7 pgs.
"Chinese Application Serial No. 201810072096.0, Office Action dated Mar. 19, 2019", w/ English Translation, (Mar. 19, 2019), 14 pgs.

* cited by examiner

SECTION A-A

SCALE 5:1

DETAIL B
SCALE 10:1

20
23a 20
23b 20
23c 20
23d

HAIR DRYER

FIELD OF THE INVENTION

The invention relates to improved air filters for hair dryers, and to methods of manufacture of such filters.

BACKGROUND TO THE INVENTION

A typical hand-held hair dryer comprises a hand-held housing with an air inlet, an air outlet, and a motor in between to draw air in from the air inlet and drive air out from the air outlet. A heating element is located in the air flow between the air inlet and the air outlet, typically after the motor in the air flow.

In some preferred implementations of a hair dryer the motor is coupled to a mix flow impeller, which draws air in axially and generates a high air pressure by thrusting the air outwards, where it is confined by the housing and forced through the hair dryer air outlet. The high pressure achieved by such a technique is useful in forcing apart the strands of hair.

Typically a hair dryer is provided with a filter on the air inlet which, among other things, stops hair from being accidentally drawn into the motor. Known filters are typically either formed by plastic injection moulding or use a metal mesh. However such filters can cause problems because over time dust and other debris builds up in the filter, reducing the air pressure and with more severe clogging causing overheating of the element and cyclical cutting-out the hair dryer resulting in a hot/cold air flow.

It is desirable to improve upon the prior art filtering techniques.

SUMMARY OF THE INVENTION

According to a first aspect of the invention there is provided a hair dryer having a hand-held housing comprising an air inlet, an air outlet, a motor between said air inlet and said air outlet to draw air in from said air inlet and drive air out from said air outlet, and a heating element located in said air flow between said air inlet and said air outlet, wherein said hair dryer further comprises a filter on said air inlet, wherein said filter comprises a metal filter plate bearing a plurality of holes, wherein at least some of said holes have a maximum lateral dimension of less than 1.5 mm and wherein walls of said holes through a thickness of said filter plate are substantially straight or at least partially concave.

In embodiments a said wall of a hole comprises at least one concave section. In other embodiments a said wall of a hole comprises a pair of sections, a first concave section and a second substantially straight section such that the hole wall is in part concavely curved and in part straight.

The structure of a metal filter plate according to embodiments of the invention provides an improved air flow through the hair dryer and contributes to addressing the problems outlined in the introduction. In some preferred embodiments at least a subset of the holes of the filter plate comprises hexagonally close-packed holes, which provide the greatest aperture to metal ratio. Preferably at least some of the holes have a maximum lateral dimension of less than 1 mm; preferably the filter plate has a thickness of less than 0.5 mm, for example approximately 0.3 mm (using a thinner plate facilitates smaller holes). Preferably a majority of the holes have a maximum lateral dimension of less than 1.5 mm or less than 1 mm; in embodiments a majority of the holes are substantially circular. In preferred embodiments the filter plate is substantially flat.

In some preferred embodiments the filter plate includes all or a subset of holes which have a maximum lateral dimension which reduces with increasing radial distance from a lateral centre of the filter. In particular when the motor is coupled to an impeller a velocity profile of the air flow defines a velocity which reduces as the circumferential edge of the air inlet is approached, and it is advantageous to match a proportion of the holes to this velocity profile. Nonetheless in some preferred embodiments a laterally central region of the filter has a reduced density of holes. Thus in embodiments there may be two subsets of holes, a first subset comprising holes of generally uniform size, and a second subset comprising holes of different sizes, more particularly sizes which reduce towards the edge of the air inlet. In some embodiments the lateral dimension of all or a subset of the holes reduces by a factor of at least 2.5.

In embodiments of the hair dryer the filter plate includes holes which are aligned along a plurality of spiral arms extending from a laterally central region of the filter; these may be the holes which reduce in lateral dimension towards the edge of the filter plate. This is because the blades of the impeller create less noise if they laterally 'cut across' the filter holes in a stepwise fashion or 'slicing' rather than cutting across holes which are aligned directly along radii. This can be more easily understood if, conceptually, the filter plate is moved so that it is adjacent the blades of the impeller, as then the blades would cut across each hole: although in practice the filter is displaced away from the impeller blades (often there is a finger guard in between) a similar effect arises. Thus, broadly speaking, in embodiments the holes, or at least some of the holes, define a pattern which has a handedness or angular sense of rotation which matches a sense of rotation of the impeller.

In embodiments of the hair dryer the filter is mounted on a user-detachable filter mount, and the filter itself is user-detachable from the filter mount, to facilitate interchange of filters. This allows the user to remove the filter, easing cleaning of the filter and allow the user to customise the hair dryer with different filters.

In some preferred embodiments the holes in the filter plate are formed by acid spray etching which helps to achieve the desired hole wall profile.

Thus a related aspect the invention provides a method of filtering air for a hair dryer, the hair dryer having a hand-held housing comprising an air inlet, an air outlet, and a motor between said air inlet and said air outlet; the method comprising: forming a metal filter plate by acid etching a plurality of holes in a metal plate such that walls of said holes are substantially straight or at least partially concave, and wherein at least some of said holes have a maximum lateral dimension of less than 1.5 mm; and using said metal filter plate to filter air drawn into said hair dryer.

In some preferred embodiments a said wall of a hole formed by said method comprises at least one concave section. In other embodiments a said wall of a hole formed by said method comprises a pair of sections, a first concave section and a second substantially straight section such that the hole wall is in part concavely curved and in part straight.

In some preferred embodiments the metal filter plate is fabricated from stainless steel.

In a further related aspect the invention provides a filter for a hair dryer wherein said filter comprises a metal filter plate bearing a plurality of holes, and wherein said holes comprise at least a subset of holes for which a lateral dimension the holes reduces with increasing radial distance from a lateral centre of said filter.

In a still further aspect the invention provides a filter for a hair dryer, wherein said filter comprises a metal filter plate bearing a plurality of holes, and wherein said holes comprise at least a subset of holes, aligned along a plurality of spiral arms extending from a laterally central region of said filter.

Preferably a filter as described above is incorporated into a hair dryer comprising an impeller located between the air inlet and an air outlet of the hair dryer.

In any of the above aspects of the invention, the metal filter plate may be flat. When the filter plate is lying flat on a horizontal surface, hole walls in the metal filter plate may be vertical walls.

In this specification 'hair dryer' is to be interpreted as covering a similar device used for hair styling.

BRIEF DESCRIPTION OF THE DRAWINGS

These and other aspects of the invention will now be further described, by way of example only, with reference to the accompanying figures in which.

DETAILED DESCRIPTION OF THE PREFERRED EMBODIMENTS

Figure 1:
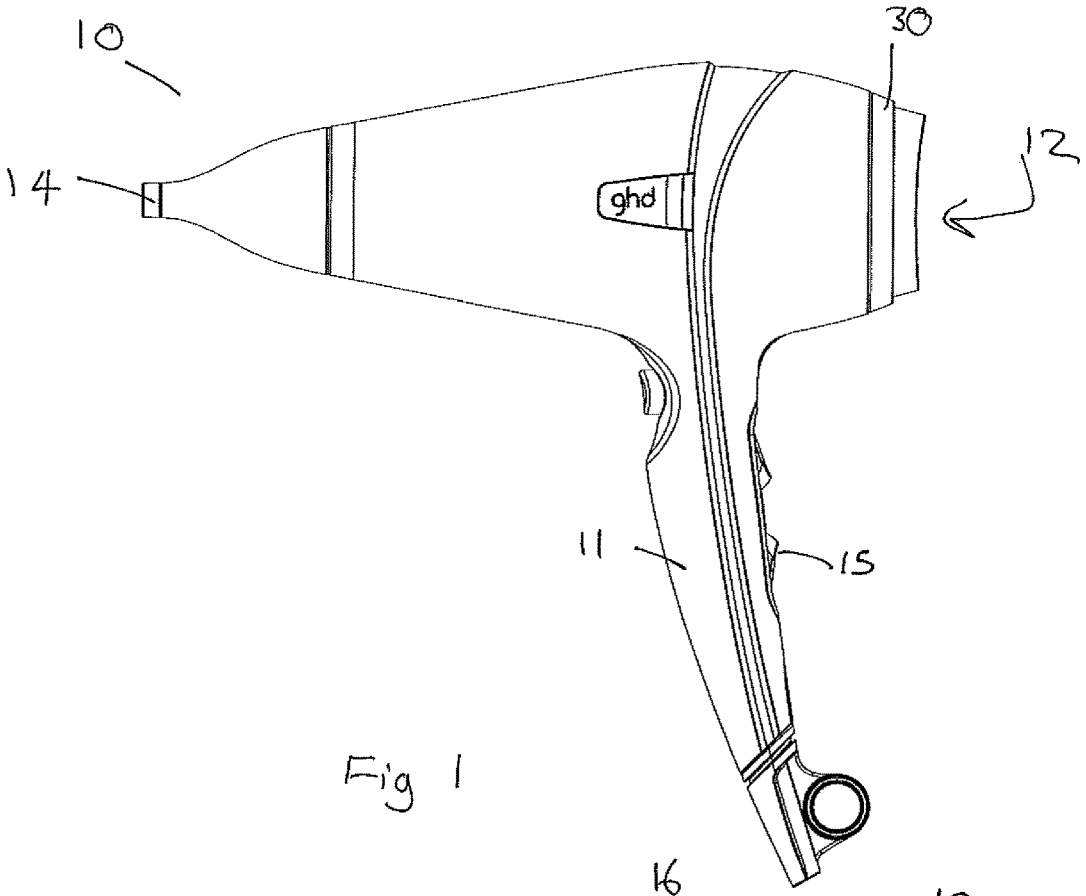
FIG. 1 shows a side view a hair dryer according to an embodiment of the invention.
Figure 2:
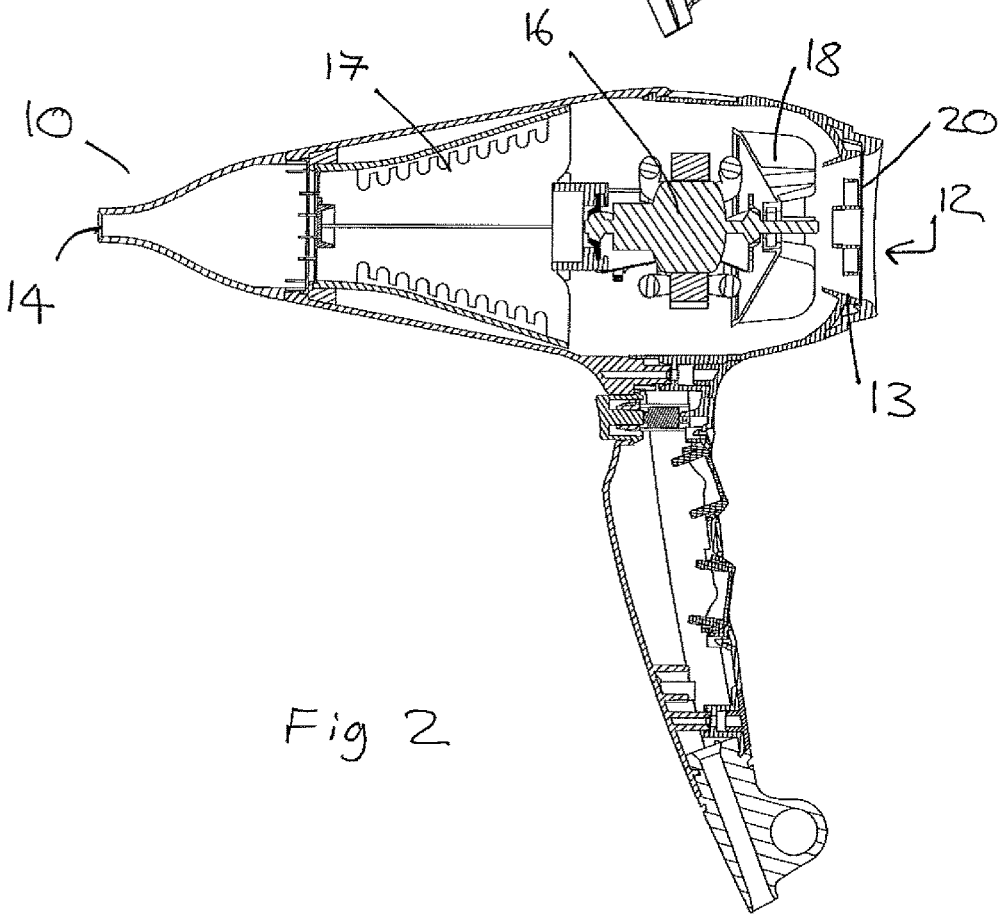
FIG. 2 shows a cross sectional view of the hair dryer of FIG. 1.

FIG. 1 shows a side view of a hair dryer 10 and FIG. 2 shows a cross sectional view of hair dryer 10 according to an embodiment of the invention. The hair dyer has an air inlet 12, an air outlet 14, a motor 16 located between the inlet 12 and outlet 14. The motor 16 powers an impeller 18 which draws in air axially from the inlet 12 and expels air radially from the impeller towards outlet 14. A heating element 17 is located between the motor and outlet to heat the air before it is expelled through the outlet. Attached to the handle 11 are controls 15 for turning the hair dryer on and off, controlling the rotational speed of the motor (and thereby controlling the flow rate of expelled air) and temperature of the expelled air.

Coupled to the rear of the hair dryer, about the air inlet 12, a metal filter plate 20 is mounted in a filter mount 30. The metal filter plate 20 attaches to the filter mount 30, the filter mount then attaches to the rear of the hair dryer so that the air inlet 12 is covered by the filter plate 20. A finger guard 13 located at the air inlet ensures that a user is prevented from inserting a finger into the body of the hair dryer with the filter mount and plate removed.

Figure 3A:
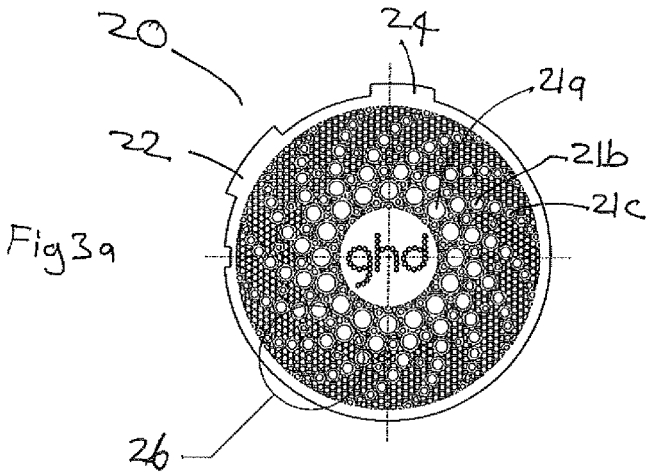
FIG. 3*a* shows an embodiment of a metal filter plate attached to the hair dryer of FIG. 1.

FIG. 3*a* shows the metal filter plate 20 that can be mounted on the air inlet of hair dryer 10. The filter plate 20 has smooth flat surfaces with an arrangement of holes through the filter to permit air to be drawn into the hair dryer whilst minimising dust, debris and hair being pulled into the hair dryer. The smooth surface also means that the filter plate is easy to clean. A portion 26 of the metal filter plate 20 is shown in more detail in FIG. 3*c*.

Figure 3B:
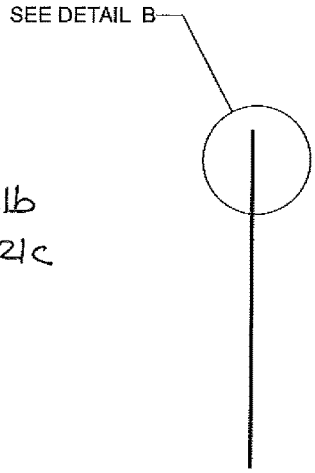
FIG. 3*b* shows a cross sectional side view the metal filter plate of FIG. 3*a;*

FIG. 3*b* shows a cross sectional side view of the metal filter plate of FIG. 3*a*. In the embodiment of FIG. 3*a*-3*d* the filter plate is made from 0.3 mm stainless steel. It will be appreciated however that other variants are possible and the composition and thickness of the metal plate may vary.

Locating lugs 22, 24 control the positioning of the filter plate when engaged to the filter mount 30 on the hair dryer. Corresponding receptors on the filter mount 30 ensure that the filter plate is arranged to sit in a prescribed position within the mount. This prevents the filter plate rotating unintentionally thereby ensuring the arrangement of holes on the filter plate is optimised. The filter plate 20 is removable from the mount for cleaning and optionally changing with another filter plate.

The lateral dimension of some of the holes in the filter plate decreases with increasing radial distance from the centre of the filter plate as shown by holes 21*a*, 21*b* and 21*c* respectively. This provides a higher proportion of holes approaching the centre of the filter where the velocity profile of the drawn in air can be higher. In FIG. 3*a* for example, the holes are arranged into a spiral formation, with holes decreasing in size towards the outer edge of the filter plate. In the embodiment show, the laterally central region of the filter (which in the embodiment show aligns with the axis of the motor 16 and impeller 18 in FIG. 2) has minimal holes.

Figure 3C:
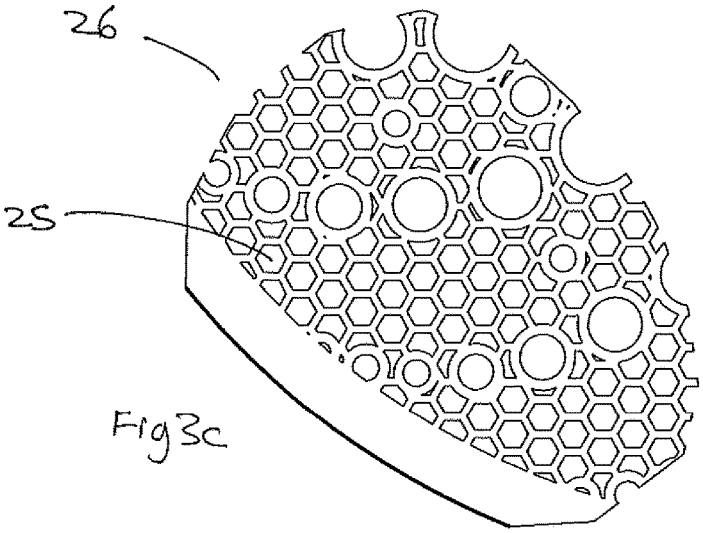
FIG. 3*c* shows a zoomed in view of a portion of the metal filter plate of FIG. 3*a;*
Figure 3D:
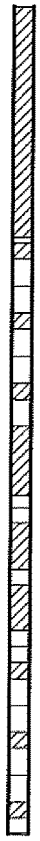
FIG. 3*d* shows a zoomed in cross sectional side view of the portion of the metal filter plate of FIG. 3*c;*
Figures 4A, 4B, 4C, 4D:
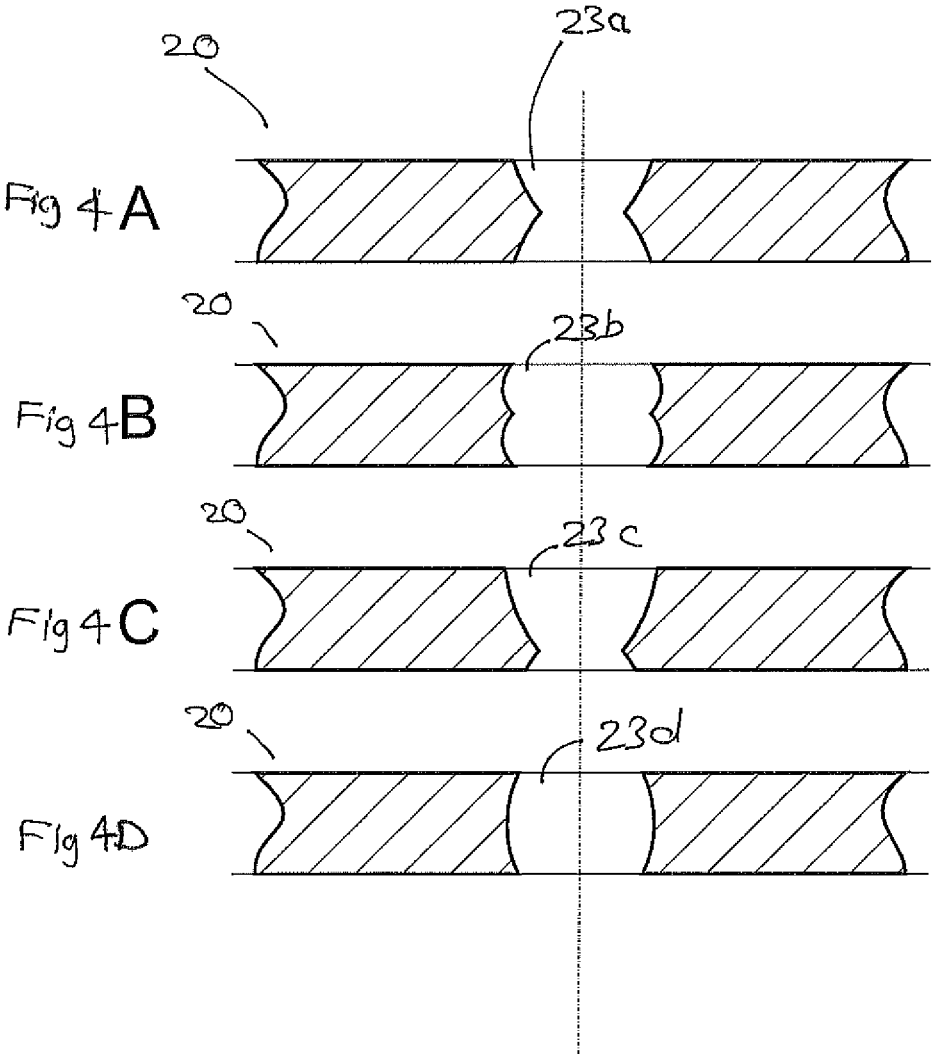
FIGS. 4*a*-4*d* show variations in the walls of holes of the filter plate of FIG. 2*a;*

Referring now to FIG. 3*c*, this shows a five times zoomed in view of a portion 26 of filter plate 20. FIG. 3*c* shows how some of the holes are formed as hexagonal holes 25 in the filter plate to permit a high density arrangement of holes. In the embodiment shown, the lateral dimension of these hexagonal holes 25 are approximately 1 mm (some less) and the holes are separated by a distance of approximately 0.25 mm. FIG. 3*d* shows a cross sectional side view of the metal filter plate portion of FIG. 3*c*.

FIGS. 4*a*-4*d* shows cross sectional view of the sections of the metal filter plate 20 of FIG. 3*a*. FIGS. 4*a*-4*d* show variations on the walls of the holes 23*a*, 23*b*, 23*c*, 23*d* formed by spray acid etching a stainless steel sheet to form the filter plate. Holes 23*a*-23*d* for example show hole walls with concave sections. The spray acid etching may also leave a portion of walls of some holes substantially flat; others may have a section that is flat and a section concave. Spray acid etching from both sides of the sheet, for example, may result in a 'double concave' surface topography such as shown by hole 23*b*. Very small holes are achievable with such a process with the embodiment herein shown having holes with lateral dimensions down to approximately 1 mm to ensure an adequate air flow (although smaller holes may be present if so desired, preferably in the vicinity or larger holes to maintain an adequate air flow).

Figure 5:
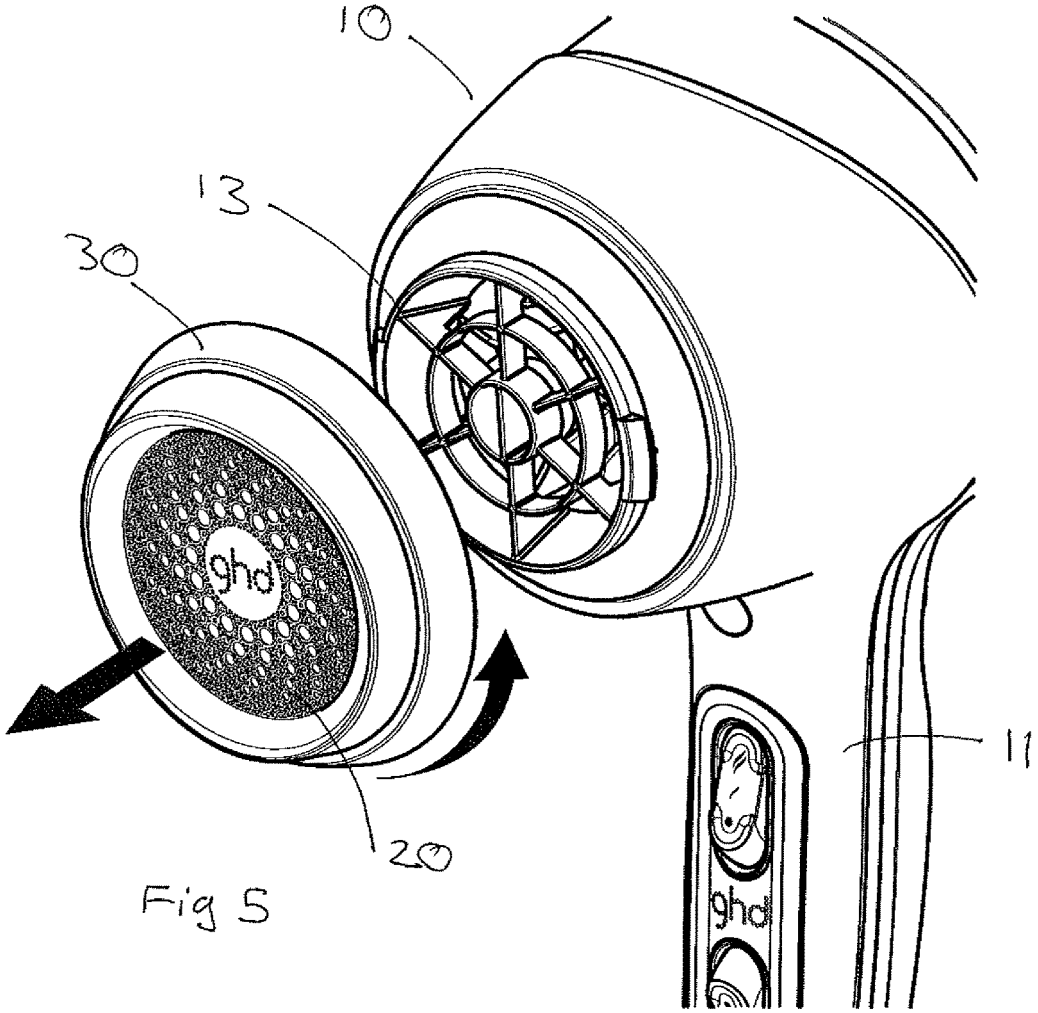
FIG. 5 shows a 3D view of the rear of the hair dryer of FIG. 1 showing the filter of FIG. 3*a* and a filter mount.

FIG. 5 shows a 3D view of the rear of the hair dryer 10 with the filter mount 30 and filter plate 20 attached. Also shown in more detail is the finger guard 13. The filter mount 30 couples to the rear of the hair dryer via a thread (or any other conventional locking system).

Figure 6:
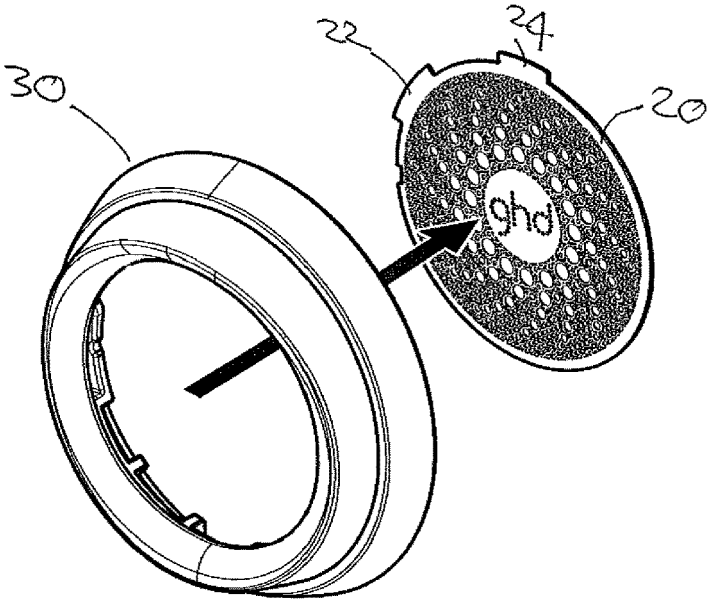
FIG. 6 shows the filter plate of FIG. 3*a* detaches from a filter mount.

FIG. 6 shows an exploded view of the filter plate 20 and filter mount 30. The filter plate fits into the filter mount 30, guided by lugs 22, 24 being received into corresponding locating holes on the filter plate. These prevent the filter plate rotating within the mount.

No doubt many other effective alternatives will occur to the skilled person. It will be understood that the invention is not limited to the described embodiments and encompasses modifications apparent to those skilled in the art lying within the spirit and scope of the claims appended hereto.

The invention claimed is:

1. A hair dryer having a hand-held housing comprising:

an air inlet, an air outlet, a motor and impeller between the air inlet and the air outlet to draw air in from the air inlet and drive air out from the air outlet, a finger guard in the air inlet to prevent a user inserting a finger into the hair dryer;

a heating element located between the air inlet and the air outlet, a filter on the air inlet, wherein the filter is a metal filter plate having an inner surface facing towards the motor and an outer surface facing away from the motor, the inner surface and the outer surface being parallel with each other and being separated by a thickness of the metal filter plate, wherein the metal filter plate comprises:

a plurality of circular holes extending through the thickness of the metal filter plate between the outer surface and the inner surface of the metal filter plate, the plurality of circular holes aligned so as to form a plurality of spiral arms extending from a laterally central region of the filter, wherein at least some of the plurality of circular holes have a maximum lateral dimension of less than 1.5 mm, wherein a wall of each of the plurality of circular holes through the thickness of the metal filter plate is at least partially concave in the thickness direction, wherein the plurality of circular holes have radii that reduce with increasing radial distance from the laterally central region of the filter plate, the metal filter plate has an increasing proportion of hole to plate approaching the center of the metal filter plate to allow a higher velocity profile of air drawn into the hair dryer towards the laterally central region of the filter plate, and a plurality of close-packed hexagonal holes, wherein the hexagonal holes are dispersed in and around the plurality of spiral arms.

2. A hair dryer, as claimed in claim 1, wherein the metal filter plate is flat.

3. A hairdryer as claimed in claim 1, wherein the lateral dimension reduces by factor of at least 2.5.

4. A hair dryer as claimed in claim 1, wherein at least some of the plurality of circular holes have a maximum lateral dimension of less than 1 mm and wherein the thickness of the filter plate is less than 0.5 mm.

5. The hair dryer of claim 1, wherein the wall of each of the plurality of circular holes has a concave profile.

6. The hair dryer of claim 1, wherein the wall of each of the plurality of circular holes has a double concave profile that is symmetric about a midpoint of the hole wall.

7. A hair dryer as claimed in claim 1, wherein the wall of each of the plurality of circular holes comprises a pair of sections, a first concave section and a second substantially straight section.

8. A hair dryer as claimed in claim 1, wherein the plurality of circular holes are formed by acid spray etching.

9. A hair dryer as claimed in claim 1, further comprising a filter mount for mounting the metal filter plate, wherein the filter mount is user-detachable from the hair dryer, and wherein the metal filter plate is user-detachable from the filter mount.

10. The hair dryer of claim 1, wherein the metal filter plate further comprises a lug located along a perimeter of the metal filter plate, the lug sized to be received within a filter mount configured to attach to the housing proximate the air inlet.

11. A hair dryer as claimed in claim 1, wherein the heating element is located between the impeller and the air outlet, and wherein the impeller is located between the air inlet and the heating element and is configured to draw in air axially from the air inlet and to expel the air radially from the impeller.

* * * * *